United States Patent [19]

Conner

[11] Patent Number: 4,893,739

[45] Date of Patent: Jan. 16, 1990

[54] POCKET FOR GOLF ACCESSORIES

[76] Inventor: Gail B. Conner, P.O. Box 307, 15 Hunting Ridge Rd., Manakin Sabot, Va. 23103

[21] Appl. No.: 798,300

[22] Filed: Nov. 15, 1985

Related U.S. Application Data

[63] Continuation-in-part of Ser. No. 625,816, Jun. 28, 1984, abandoned.

[51] Int. Cl.[4] ..... A45F 5/00

[52] U.S. Cl. ..... 224/240; 224/242; 224/249; 224/252; 224/253; 224/269; 224/901; 224/904; 224/918; 224/919

[58] Field of Search ..... 224/253, 918, 919, 904, 224/908, 240, 242, 249, 252, 269, 901

[56] References Cited

U.S. PATENT DOCUMENTS

| | | | |
|---|---|---|---|
| 551,359 | 12/1895 | Braillard | 224/253 |
| 1,214,282 | 1/1917 | Day | 224/249 X |
| 1,806,797 | 5/1931 | Guiterman | 224/918 X |
| 2,682,981 | 7/1954 | Preuidi | 224/253 X |
| 3,320,620 | 5/1967 | Weidler et al. | 224/918 X |
| 3,674,189 | 7/1972 | Walbeck | 224/918 X |
| 3,813,017 | 5/1974 | Pimsleur | 224/908 X |
| 3,830,415 | 8/1974 | Jacobson et al. | 224/249 X |
| 4,356,943 | 11/1982 | Berman | 224/253 X |

FOREIGN PATENT DOCUMENTS

| | | | |
|---|---|---|---|
| 624295 | 7/1981 | Switzerland | 224/229 |
| 227180 | 1/1925 | United Kingdom | 224/919 |
| 354464 | 8/1931 | United Kingdom | 224/226 |

*Primary Examiner*—Henry J. Recla
*Attorney, Agent, or Firm*—William J. Bundren

[57] ABSTRACT

A golf ball and accessory pouch is disclosed. The pouch is designed to carry one or more golf balls, a pencil, golf tees, a divot tool, and a ball marker. The pouch can be attached to the wearer's belt, is made of soft material so that it can be easily stored when not in use, and conforms to the wearer's body in such a fashion as to not impede or detract from the wearer's swing.

4 Claims, 1 Drawing Sheet

POCKET FOR GOLF ACCESSORIES

This is a continuation-in-part of pending patent application Ser. No. 625,816, filed June 28, 1984 now abandoned.

DESCRIPTION AND BACKGROUND

The present invention relates to an improved pouch suitable for carrying on a belt or trousers one or more golf accessories such as tees, markers, divot tools, pencils and the like. This invention is particularly intended to carry the above-noted implements of the golf game, while at the same time, being pliant enough to partially conform to the wearer's body so as not to interfere with the golfer's swing. This invention is also intended to carry oft-needed implements of the game in an easily-accessible manner while not detracting from the wearer's appearance or ability to play the game. In the prior art, various pockets or holders are employed to carry golf articles. Primley (Pat. No. 1,648,565) discloses a rigid golf ball carrier suitable for attachment to a belt. Although it provides space for several implements of the game, the rigidity of the box makes accessibility to these implements more difficult and inconvenient. Also, the rigid box may be worn in only limited places along the wearer's waist because it does not mold to the body and therefore obstructs the golfer's swing.

Weidler et al (U.S. Pat. No. 3,320,620) discloses an auxiliary pocket for golfers. Because of the nature of the pocket, it can not carry a variety of golfing implements. Also, it must be placed in the golfer's back pocket, making accessibility inconvenient and awkward. Previdi (U.S. Pat. No. 2,558,382) is similar to Weidler's pocket, but can be carried on a belt. It, however, can not carry a pencil, marker, or divot tool. This holder also tends to drop carried articles because nothing completely encloses the articles.

SPECIFIC DISCLOSURE

Figure 1:
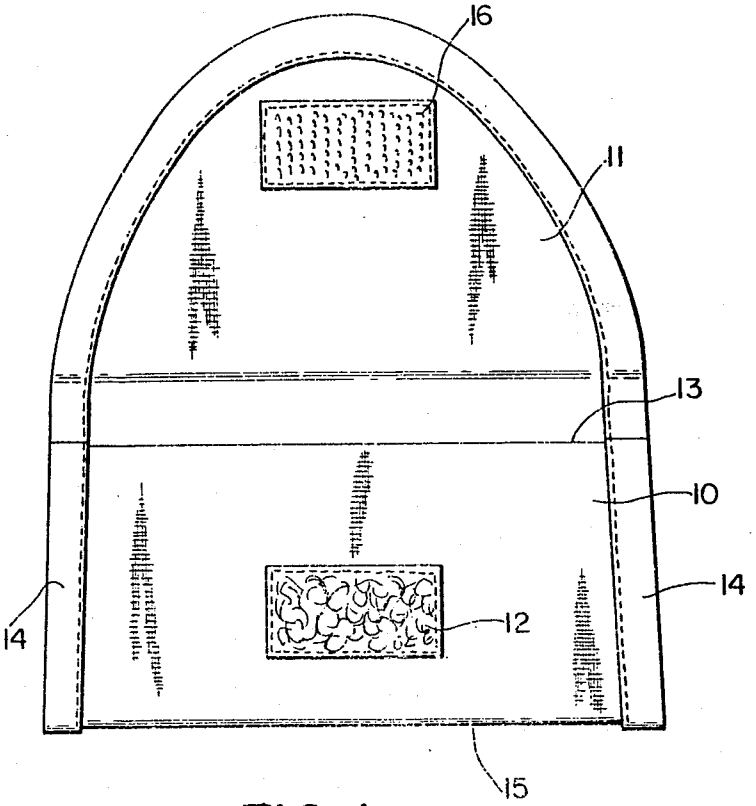
FIG. 1 is a front view of the invention with the flap open.

Referring to the Figures, which illustrate one practical illustration of the invention, FIG. 1 is a golf ball and accessory pouch in the open position. This pouch is preferably made of leather; however, any suitable material or fabric, such as nylon, may be used. A main section 13 is formed either by folding part of the material over and stitching the two vertical sides 14, or by adding a separate piece of material and stitching the pieces together at vertical sides 14 and horizontal side 15. Flap 11, in its closed position, folds over the lower portion 13 and first sheet 10 to form the pouch-like receptacle. The flap 11 is preferably held in a closed position by Velcro strips, pieces 12 and 16. Although Velcro is preferred, other means of attachment may be used, such as one or more snaps, a zipper, or one or more buttons. In this manner, one or more golf balls can be safely enclosed in the receptacle.

The pouch comprises a flap portion 11 and a lower portion 13. Lower portion 13 and first sheet 10 may be attached at side edge 14 to form a pouch-like receptacle.

It is preferred that first sheet 10 is an extension of lower portion 13 and is folded over lower portion 13 in an opposing facing relationship in order to form the pouch-like receptacle. In this embodiment, only side edges 14 need be attached. As an alternative, first sheet 10 may be a separate member attached in an opposing facing relationship at side edges 14 and bottom edge 15. Although the preferred method of attachment is stitching the lower portion and the first sheet together, any suitable form of attachment means can be used.

In order to provide easy access, golf accessories are preferably attached to the outside of flap 11. A loop 22 may be attached to flap 11 as a means to hold a pencil. This is preferably located just below the top edge of the pouch as it rests on a wearer's belt. However, this loop may be placed on the top edge of the flap.

The lower section of the flap is used for holding tees, a divot tool, and a ball marker(s). The slot-like receptacles 21 are formed by attaching a second sheet 20 to flap 11. This second sheet is cut to conform to the shape of flap 11. Second sheet 20 is secured to the outside of flap 11 by a cross strip member 17 and attaching means along the perimeter of flap 11. Slot-like receptacles 20 and 21 are sewn at spaced locations 18, 19, 24 and 25 to hold golf tees (at spaced locations 18), and a divot tool (at spaced locations 19, 24 and 25). Slot-like receptacle 20 also contains a button hole-type slot 23 to hold one or more ball markers.

Figure 2:
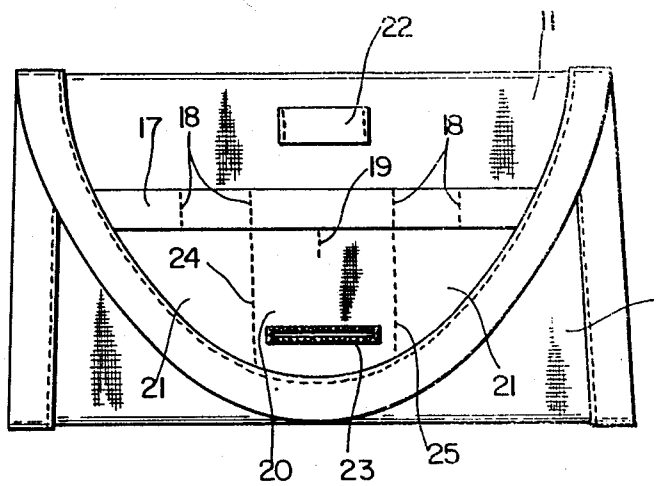
FIG. 2 is a front view of the invention with the flap closed.
Figure 3:
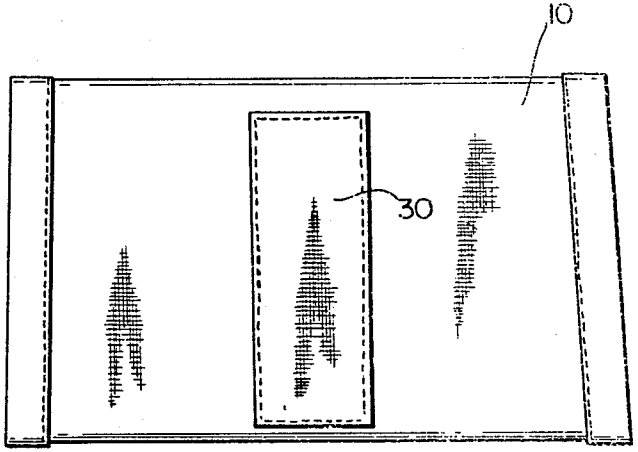
FIG. 3 is a rear view of the invention.

FIG. 3 details the rear view of the invention. A belt attachment 30 is sewn into the back of lower portion 13 at a position suitable for attachment to a belt. A variety of belt attachment means may be used: a clip (sewn or glued to lower portion 13), a Velcro strip, or a permanently sewn belt loop.

I claim:

1. A pouch suitable for carrying golf balls and golf accessories comprising a main section having a lower portion and a flap portion; said lower portion secured in opposing facing relationship to a first sheet by suitable side edge attachment means to form a pouch-like receptacle; said flap portion arranged to fold downwardly upon the outside wall of said pouch-like receptacle and thus forming a closed receptacle; said flap portion containing means to secure in a closed position said flap to said receptacle; said flap portion including a retaining loop for a pencil; and a second sheet shaped to conform to the shape of said flap, and secured in an opposing facing relationship to said flap by suitable attachment means to form slot-like receptacles, said slot-like receptacles containing spaced locations for one or more golf tees, and a divot tool, and also containing a button-hole type slot for receiving one or more ball markers.

2. A pouch according to claim 1 wherein said pouch-like receptacle is formed by folding said first sheet over said lower portion and attaching said first sheet to said lower portion by side edge attachment means.

3. A pouch according to claim 1 wherein said first sheet is a separate member and said pouch-like receptacle is formed by attaching said first sheet to said lower portion by side edge and bottom edge attachment means.

4. A pouch according to claim 1 wherein said means to attach said flap to said receptacle is one of the following attachment means: Velcro strips; snap or snaps; zipper; or one or more buttons.

* * * * *